United States Patent [19]

Hippely

[11] Patent Number: 4,558,867

[45] Date of Patent: Dec. 17, 1985

[54] TOY VEHICLE TRACKWAY SET

[75] Inventor: Keith A. Hippely, Manhattan Beach, Calif.

[73] Assignee: Mattel, Inc., Hawthorne, Calif.

[21] Appl. No.: 566,594

[22] Filed: Dec. 29, 1983

[51] Int. Cl.[4] ..... A63B 67/00

[52] U.S. Cl. ..... 273/412; 446/75; 446/444

[58] Field of Search ..... 446/168, 173, 174, 431, 446/444–447, 75, 76; 238/10 R, 10 A, 10 E, 10 F; 273/412, 405, 86 B, 86 C; D21/143, 446, 273

[56] References Cited

U.S. PATENT DOCUMENTS

| | | | |
|---|---|---|---|
| D. 251,924 | 5/1979 | Okado | D21/143 |
| D. 265,751 | 8/1982 | Udagawa | D21/143 |
| 2,072,682 | 3/1937 | Morgan | 273/412 |
| 3,683,514 | 8/1972 | Hughes | 446/137 X |
| 3,735,923 | 5/1973 | Brigham et al. | 238/10 E |
| 4,146,991 | 4/1979 | Sano . | |
| 4,285,157 | 8/1981 | Lambert . | |

OTHER PUBLICATIONS

"Matchbox" Lesney Products Corp., London, England ©1970, pp. 4 & 5.

*Primary Examiner*—Mickey Yu

*Attorney, Agent, or Firm*—Ronald M. Goldman; Melvin A. Klein

[57] ABSTRACT

A toy vehicle trackway set includes a base member defining a circular ramp, a vehicle loop, a straight track segment and a vehicle receiving net.

The trackway may be assembled in a first configuration in which a self-powered toy vehicle may be accelerated sequentially through the straight track, the loop, and the ramp and be launched from the ramp toward the receiving net or in a second configuration in which the straight track serves as a handle, the loop snap fits about the ramp and the receiving net snaps inside the ramp to captivate one or more toy vehicles.

4 Claims, 3 Drawing Figures

11
12
14
15
16
18
20
22
23
24
26
27
28
29
30
31
32
34
35
36
40
41
50
51
52

15
14
37
44
40
11
40
11
18
16
26
12
10
22
20

TOY VEHICLE TRACKWAY SET

FIELD OF THE INVENTION

This invention relates generally to toy vehicle track sets and particularly to those using self-powered toy vehicles.

BACKGROUND OF THE INVENTION

Through the years many toy vehicle track sets have been created in which self-powered vehicles are used. Typically such toy vehicles are powered by wind-up motors, electric motors, or inertial motors. Less often, perhaps, toy vehicles are used to which a velocity has been imparted by traveling a down sloping acceleration ramp at the entrance to the guided trackway. Many of such trackways are multipy-curved to add interest value and often include combinations of vertically and horizontally oriented track loop portions. As a further refinement, some such toy vehicle sets have a track configuration so structured that it serves a dual purpose. For example U.S. Pat. No. 4,285,157 issued to Gerard L. Lambert and which is assigned to the assignee of the present invention, sets forth a toy vehicle racing set for use with a powered toy vehicle in which split carrying case halves are hinged at a common edge to serve as both a carrying case and a portion of the trackway.

As to play value, for the most part, such trackway sets generally have as their primary source of player interest either the observation of the toy vehicle negotiating the multiply-curved trackway, and/or the added interest of a race between competing vehicles operating on the trackway.

SUMMARY OF INVENTION

It is a general object of the present invention to provide and improve a toy vehicle trackway set. It is a more particular object of the present invention to provide an improved toy vehicle trackway set which may be alternatively assembled in either an operative configuration or storage configuration. It is a still more particular object of the present invention to provide a toy vehicle trackway set in which an element of skill is added to the game to increase the interest value of the participants.

In accordance with the invention, a toy vehicle trackset for use in combination with a miniature toy vehicle is used in which the vehicle is accelerated through a multiply-curved trackway which terminates in an upwardly projecting ramp portion and from which the toy vehicle is launched in a projectile path. The landing point of the toy vehicle varies as a function of the vehicle's pre-launch velocity. A freely moveable vehicle receiving member is placeable by the participant in accordance with an attempt to predict the eventual impact point of the launched vehicle. It is one object of the game to predict the vehicle impact point with sufficient accuracy and to place the vehicle receiving means with sufficient skill that the launched toy vehicle is "caught" by the vehicle receiving means.

BRIEF DESCRIPTION OF THE DRAWINGS

The features of the present invention which are believed to be novel are set forth with particularity in the appended claims. The invention, together with further objects and advantages thereof, may be best understood by reference to the following description taken in conjunction with the accompanying drawings, in the several figures of which like reference numerals identify like elements, and in which:

DESCRIPTION OF THE PREFERRED EMBODIMENT

Figure 1:
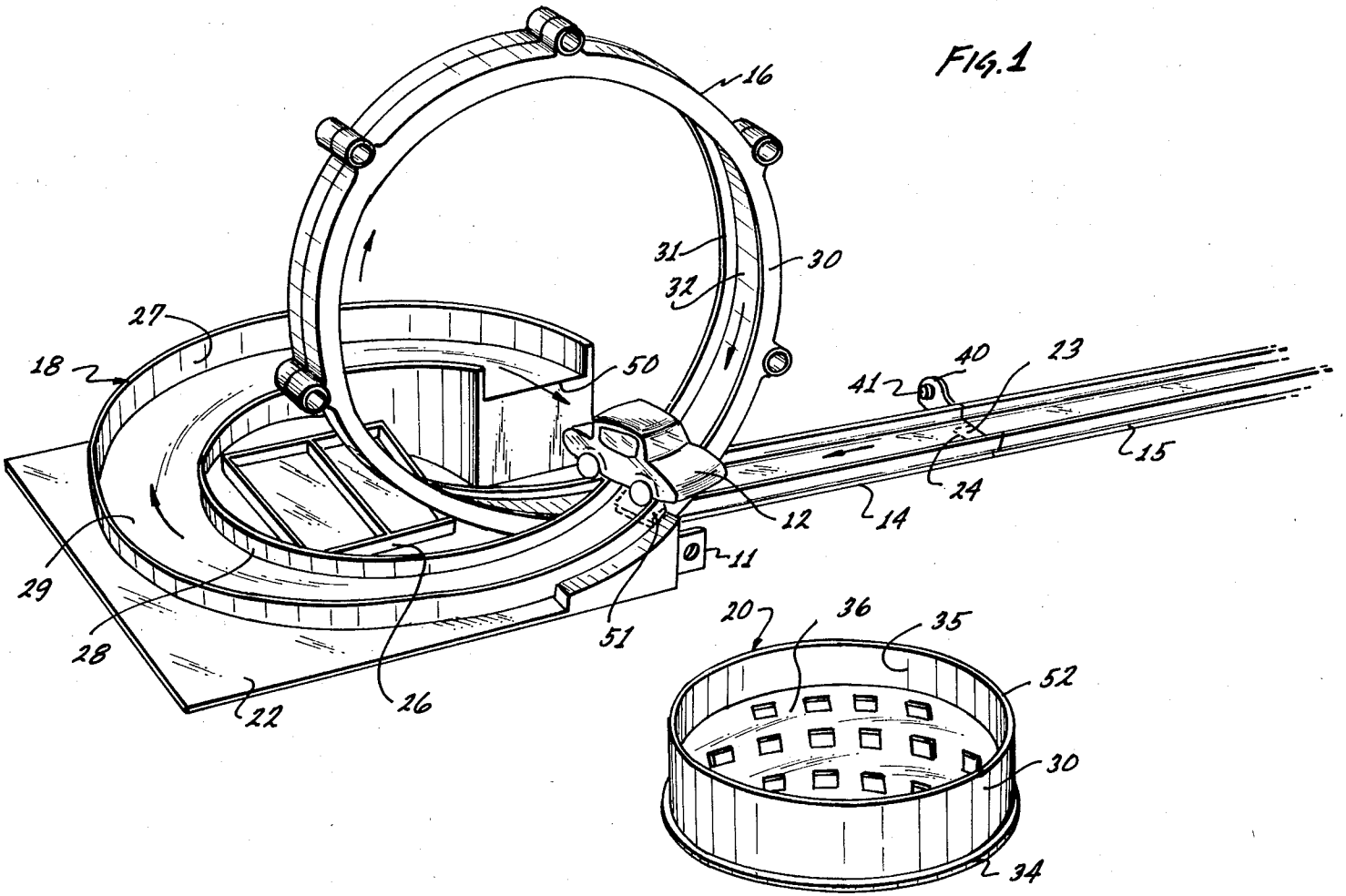
FIG. 1 is a pictorial view of a toy vehicle trackway set constructed in accordance with the present invention and assembled in its operational configuration.

FIG. 1 is a perspective view of the present invention toy vehicle trackway set. A pair of straight track segments 14 and 15 which include a pair of side walls 38 and 55 respectively and a raceway 54 are interconnected at a common end by coupling means 23 and 24. A base member 22 defines a ramp portion 18 comprised of a generally circular shaped inclined raceway 29 bounded on the interior side by a ramp wall 28 and on the exterior side by a ramp wall 27. Ramp 18 terminates at its lower end at an entrance point 51 and at its higher end at an exit point 50. A track loop 16 is formed of a resilient material in a generally circular shape and includes a raceway 32 bounded on either side by raised walls 30 and 31. Track loop 16 is coupled at one end to entrance point 51, by means described below in greater detail, and to base 22 in a manner placing raceway 32 in alignment with raceway 54 of track 14 at the other end by means described below in greater detail. Track 14 again by means described below in greater detail is coupled to base 22 in alignment with the proximate end ot track loop 16

Base 22 further defines a pair of vehicles storage cavities 26 located within the area of base 22 bounded by the interior wall 28 of ramp 18. The purpose and function of vehicle storage cavities 26 will be described below in greater detail. A vehicle receiving means 20 includes a generally cylindrical member 52 having an exterior surface 33 and an interior surface 35. A substantially planar net portion 36 extends inward from inner wll 35. Net portion 36 and interior wall 35 form a vehicle receiving cavity. Cylinder 52 further defines an expanded rim portion 34 which for reasons set forth and explained below in greater detail has an outside diameter slightly, greater than the inside diameter of ramp wall 28.

In operation, toy vehicle 12 which may be either self-powered as for example driven by springwound, electric, or inertial motor is initially directed down straight track 14 and 15 and thereafter traverses the interior portion of track loop 16 along raceway 32 and leaves track loop 16 and enters ramp 18. As an alternative, toy vehicle 12 may also enter track 15 having kinetic energy rather than being self-powered. For example toy vehicle 12 may have descended a downward sloped ramp portion or simply been launched down the straight track portion formed by segments 14 and 15 by the player participant. In either case, the vehicle then travels up raceway 29 of ramp 18 and is guided by interior wall 28 and exterior wall 27 and arrives at exit point 50. Upon reaching exit point 50, the velocity of the toy vehicle causes the vehicle 12 to continue moving and be launched beyond ramp 18 through the plane of loop 16 toward vehicle receiving means 20.

In the position shown, toy vehicle 12 has just left exit point 50 and due to its velocity at that point is traversing the plane of track loop 16. Toy vehicle 12 once launched continues toward vehicle receiving means 20 in a ballistic path and, depending upon the skill with which the participant has placed vehicle receiving means 20, will either miss vehicle receiving means 20 entirely, impact a portion of vehicle means 20 and fall out outside of vehicle means 20 or impact the vehicle means 20 either at the interior wall 25 or net portion 36 in which case vehicle 12 will come to rest upon net means 36. The final possibility is of course the desired one and marks a successful placement of vehicle receiving means 20.

Figure 2:
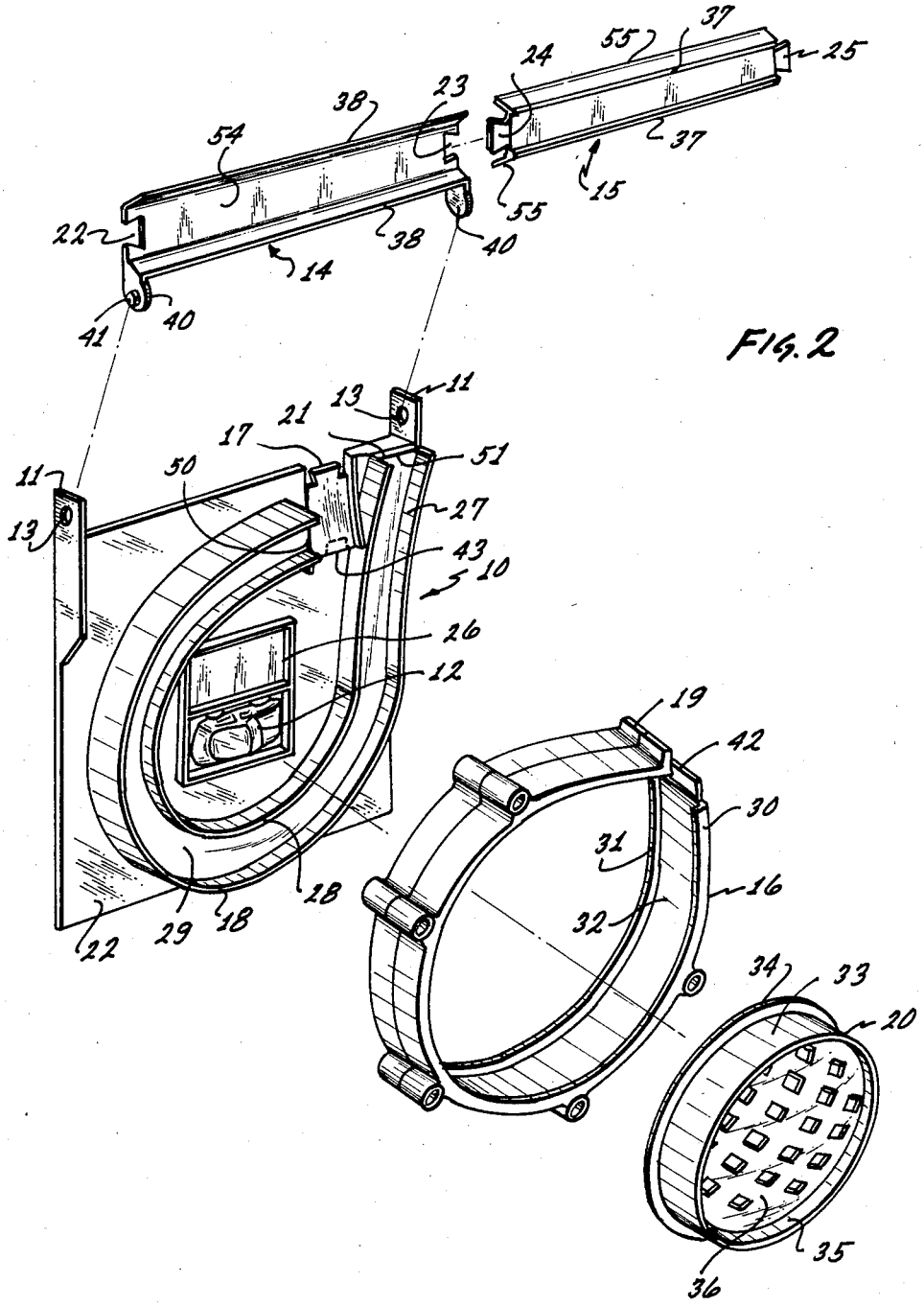
FIG. 2 is an exploded-view of the trackway set of FIG. 1 showing respective special relationships of the parts prior to configuration of the trackway set components in the storage configuration.

FIG. 2 shows an exploded view of the trackway set of FIG. 1 in which base member 22, track loop 16, vehicle receiving means 20, and straight track members 14 and 15 have been separated one from the other disassembling the configuration previously described in connection with FIG. 1. The members shown in FIG. 2 are aligned in the appropriate positions preparatory to reassembling the present invention trackway set in its alternative storage configuration. At this point attention is invited to the construction of straight track 14 in greater detail. Track 14 includes a raceway 54 and a pair of raised wall portions 38 on either side thereof together with a pair of coupling means 22 and 23 at either end and a pair of hinge appendages 40 which extend generally perpindicular to raceway 54. Each of appendages 40 further define an outwardly projecting post 41. Similarly, straight track 15, which is shown rotated 180° from the alignment of straight track 14 (i.e., exposing its underside) defines a straight raceway (not shown in FIG. 3) and a pair of wall portions 55 constructed in a similar manner to wall portions 38 of track section 14. Straight track 15 further includes a pair of coupling means 24 and 25 spaced at opposite ends thereof which are compatible with coupling means 23 of straight track portion 14. It will be apparent to those skilled in the art that any number of coupling means arrangements 23 and 24 can be used with the object of aligning and connecting track portions 14 and 15 without departing from the spirit and scope of the present invention. For example, a tongue and groove combination would serve the same purposes of coupling means 24 and 23.

Straight track 15 also accommodates a pair of nesting members 37 on its underside. And shown more clearly in FIG. 3, straight track 14 defines a corresponding nesting member channel 44 which is compatible with nesting means 37 on straight track 15 to permit straight track 14 and 15 to be nested and form an appropriately shaped handle the importance of which will set forth below in greater detail. Again, as was the case with coupling means 23 and 24, those skilled in the art will be able to conceive of numerous corresponding nesting devices and structures by which straight track portions 14 and 15 may be nestable in handle-like configuration without departing from the spirit and purpose of the present invention.

Turning now to base member 22 and more particularly taking note to the hinge appendages 11 which extend from the upper edge of base member 22, attention is invited to apertures 13 in appendages 11. When the present invention trackway set is assembled in its storage configuration straight track member 14 and nested track member 15 are placed in a spaced-apart relationship with base member 22 such that appendages 40 are aligned opposite the interior surfaces of appendages 11. Appendages 11 are formed of a resiliant material and therefore as trackway 14 is forced toward base 22, posts 41 on appendages 40 slightly spread hinge appendages 11 on base 22. Once posts 41 are brought into alignment with holes 13 in appendages 11, the resilience of appendages 40 and 11 cause post 41 to snap into apertures 13. Thereafter, the resilience of appendages 11 captivates posts 41 within apertures 13. As a result, the combined nested subassembly of straight track 14 and 15 are hingably coupled to base 22 and serve as convenient carrying handle.

At this point, it should be noted that toy vehicle 12 is in FIG. 2 resting within vehicle storage cavity 26 within the interior of inside wall ramp 18. Also visible in FIG. 2 are coupling means 43 and 17 which in the operational configuration shown in FIG. 1 supply an interconnective coupling between coupling means 42 on track loop 16 and coupling means 22 on straight track 14 respectively. Similarly, coupling means 21 on base 22 cooperate with coupling means 19 on track loop 16 to retain track loop 16 in the configuration shown in FIG. 1.

Returning now to assembly of the present invention trackway set in its storage configuration track loop 16 is as mentioned, formed of a resilient material and therefore may be expanded by separation of its end portions to increase the internal diameter of the circular configuration of wall portion 31 to a diameter greater than that of the exterior wall 27 of ramp 18. When so expanded, track loop 16 may be positioned surrounding a portion of the periphery of ramp 18 and released. The resilience of track loop 16 causes it to close about the exterior wall 27 of ramp 18 resulting in a gripping action by track loop 16 sufficient to retain it in position against base member 22 and embracing ramp 18.

Vehicle receiving means 20, as mentioned above, defines a raised rim 34 having an outer diameter slightly greater than the interior of wall 28 of ramp 18 and in the storage position is placed overlying vehicle storage cavity 26 and vehicle 12 resting therein. As vehicle receiving means 20 is pressed toward base member 22 an interference fit between rim 34 and the interior surface of wall 28 results. Because vehicle receiving means 20 is formed of a resilient material, rim 34 is compressed slightly by this interference fit and exerts a pressure against ramp wall 28 maintaining vehicle receiving means 20 in a position overlying vehicle storage cavity 26 and captivating toy vehicle 12.

Figure 3:
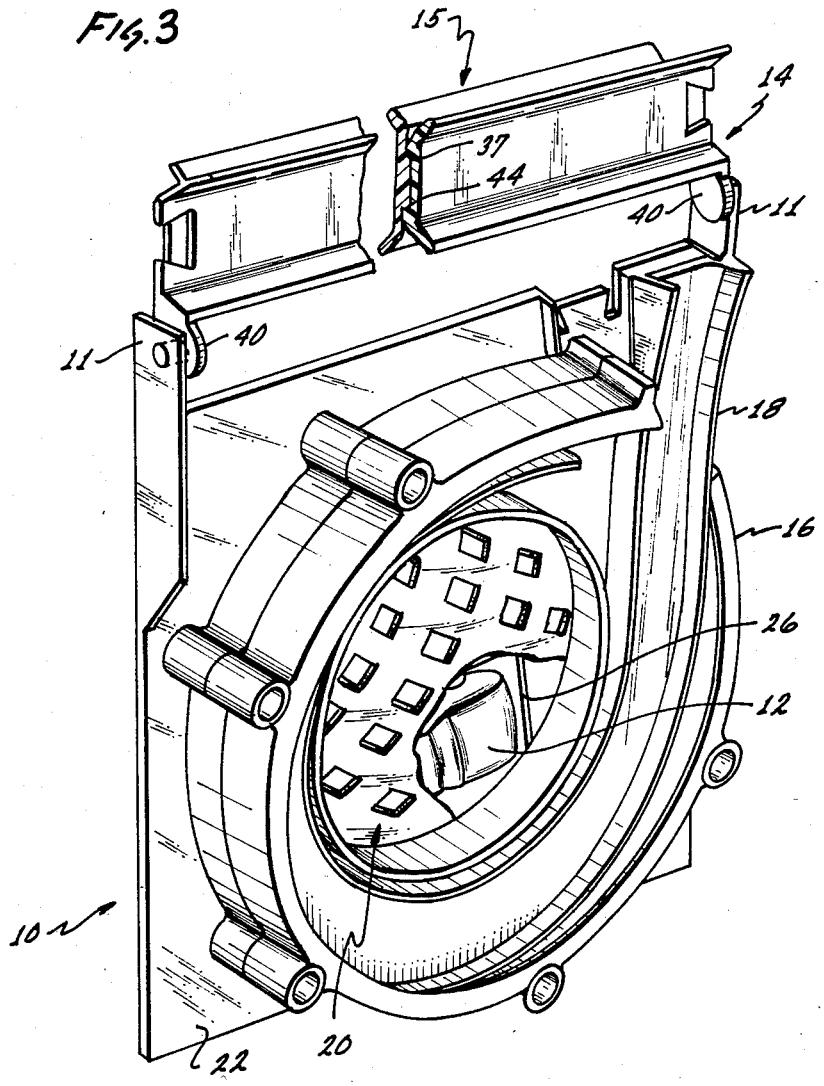
FIG. 3 is a partially sectioned pictorial view of the present invention trackway set assembled in the storage configuration.

The resulting structure when the present invention trackway set is assembled in its storage configuration is shown in FIG. 3 and as can be seen provides a compact easy to carry and store unit in which the nested straight track members 14 and 15 provide a convenient carrying handle and in which toy vehicle 12 is captivated beneath vehicle receiving 20 within cavity 26 and in which track loop 16 is retained surrounding a portion of ramp 18.

While particular embodiments of the invention have been shown and described, it will be obvious to one skilled in the art that changes and modifications may be made without departing from the invention in its broader aspects, and, therefore, the aim in the appended claims is to cover all such changes and modifications as fall within the true spirit and scope of the invention.

I claim:

1. A toy vehicle trackway set for use in combination with a miniature toy vehicle in which said toy vehicle is accelerated through a multiply-curved track and launched therefrom in a skill game wherein a player attempts to predict the resulting flight of said launched toy vehicle, said toy vehicle trackway set comprising;

an elongated straight track, said straight track having a substantially flat race surface extending the length thereof, a pair of wall portions substantially perpendicular to said race surface and extending the length of said race surface to define a track channel having a generally U-shaped cross section, and first coupling means at one end;

a track loop, having a track channel having a cross section substantially similar to that of said straight track portion, formed in an open loop configuration in which said track channel traverses the interior portion of the loop thus formed-and having second and third coupling means at opposite ends of said track loop;

a base member having a substantially planar undersurface and an upper surface defining a ramp portion raised from said upper surface having formed therein a track channel having a cross section substantially corresponding to that of said straight track portion and defining an entrance point an exit point and a generally upwardly sloping curved path therebetween such that a toy vehicle entering said ramp portion is thereby raised from a first lesser height to a second greater height, undergoes a change in direction and is launched from said exit point;

said base member further defining fourth coupling means at said entrance point and fifth coupling means adjacent said entrance point, said fourth and fifth coupling means to retain said track loop in a substantially vertical position and forming a helical path, and sixth coupling means aligned with said fifth coupling means and cooperating with said first coupling means to retain said straight track in alignment with said track loop;

and vehicle receiving means freely moveable with respect to said base member and defining an upwardly facing receiving cavity for a toy vehicle.

2. A toy vehicle trackway set as set forth in claim 1 wherein said straight track includes first and second hinge appendages and wherein said base member defines third and fourth hinge appendages and a vehicle cavity on said upper surface inside the curve of said ramp for receiving at least one toy vehicle and wherein said ramp portion includes interior and exterior walls supporting it above said upper surface and wherein said vehicle receiving means defines an outer surface sized to snap fit within said interior wall of said ramp portion, said toy vehicle track set capable of being assembled in a storage configuration in which said first, second, third, fourth, fifth and sixth coupling means are separated and in which:

said first and second hinge appendages cooperate with said third and fourth hinge appendages respectively to permit said straight track to serve as a handle;

said toy vehicle is placed within said vehicle cavity and said vehicle receiving means is snapped within said interior wall of said ramp portion and captivates said toy vehicle; and said track loop is snapped around and is supported by said exterior wall of said ramp portion.

3. A toy vehicle trackway set as set forth in claim 1 wherein said vehicle receiving means comprise:

a generally cylindrical member having inner and outer wall surfaces; and a planar net portion extending across the interior of said cylindrical member at the approximate mid section thereof.

4. A toy vehicle trackway set as set forth in claim 1 wherein said elongated straight track comprises a pair of substantially similar straight track portions having means for coupling said straight track portions in serial alignment and nesting means cooperating to permit said straight track portion to be nested in a parallel relationship.

* * * * *